US005501205A

United States Patent [19]

Betz et al.

[11] Patent Number: 5,501,205

[45] Date of Patent: Mar. 26, 1996

[54] IGNITION COIL SET FOR A MULTICYLINDER INTERNAL COMBUSTION ENGINE

[75] Inventors: Dieter Betz, Vaihingen; Reinhold Herrmann, Stuttgart; Uwe Hammer, Schwieberdingen, all of Germany

[73] Assignee: Robert Bosch GmbH, Stuttgart, Germany

[21] Appl. No.: 405,537

[22] Filed: Mar. 16, 1995

[30] Foreign Application Priority Data

Jun. 10, 1994 [DE] Germany ..... 44 20 271.7

[51] Int. Cl.[6] ..... F02P 3/02; H01T 13/04

[52] U.S. Cl. ..... 123/635

[58] Field of Search ..... 123/143 C, 634, 123/635, 647

[56] References Cited

U.S. PATENT DOCUMENTS 5,109,828 5/1992 Tagami et al. ..... 123/635
5,237,982 8/1993 Asakura et al. ..... 123/635
5,390,648 2/1995 Yanase ..... 123/634

FOREIGN PATENT DOCUMENTS 0512357 11/1992 European Pat. Off. .

*Primary Examiner*—Tony M. Argenbright
*Attorney, Agent, or Firm*—Michael J. Striker

[57] ABSTRACT

An ignition coil set for a multicylinder internal combustion engine has a housing and a plurality of substantially identical ignition modules each having a primary coil and a secondary coil accommodated in the housing. A common connecting element is formed so as to provide positioning of the primary coils and the secondary coils and electrical contacting of terminals of the primary coils and low voltage side of the secondary coils when the coils are single spark coils or distribution of high voltage when the coils are formed as double spark coils, and also positioning of the housing which accommodates the ignition modules.

7 Claims, 2 Drawing Sheets

IGNITION COIL SET FOR A MULTICYLINDER INTERNAL COMBUSTION ENGINE

BACKGROUND OF THE INVENTION

The present invention relates to an ignition coil set for a multicylinder internal combustion engine.

One of such ignition coil sets is disclosed in the European patent document EP 0 512 357 A2. In this ignition coil set four individual ignition coils are placed as operational units with their own housings on a support element so that, during mounting of the support element on the motor block of the internal combustion engine in the operational position of the ignition coil set there is each associated with a corresponding cylinder of the motor block of the internal combustion engine spatially and are in contact with the associated spark plugs. The support element and the individual ignition coils are covered by a protective hood which has an opening for each individual ignition coil. Angled contact wires with busbars extending along the cover can extend through the opening outwardly of the individual ignition coils. They open into an electrical central terminal for the ignition coil set, are assembled together and connected for example by welding to provide integrated material connection. Thereby the openings in the cover are closed.

In view of high manufacturing costs, such an ignition coil set can be produced only in a cost-intensive way which is naturally undesirable.

SUMMARY OF THE INVENTION

Accordingly, it is an object of the present invention to provide an ignition coil set, which avoids the disadvantages of the prior art.

In keeping with these objects and with others which will become apparent hereinafter, one feature of the present invention resides, briefly stated, in an ignition coil set for a multicylinder internal combustion engine, having a housing accommodating a plurality of identical ignition modules corresponding to the number of the cylinders of the internal combustion engine and each having a primary coil and a secondary coil, wherein in accordance with the present invention a common connecting element is utilized for positioning of the primary coils and secondary coils as well as for contacting terminals of the primary coil and the low voltage side of the secondary coils for single spark coils or the distribution of high voltage for the double spark coils, as well as for the positioning of the housing which accommodates the ignition modules.

When the ignition coil set is designed in accordance with the present invention, it eliminates the disadvantages of the prior art. The ignition coil set has a connecting element which contacts several identical ignition modules containing a primary coil and a secondary coil and also positions the housing which accommodates the ignition modules.

When the ignition coil set is provided with such a connecting element, it is possible to manufacture the ignition coil sets in a cost-favorable manner with low manufacturing expenses.

In accordance with another feature of the present invention the connecting element can be formed as a substantially flat plastic coated punched grid provided with contacting points and subdividable into busbars which are electrically isolated from one another and assembled in a central terminal of the ignition coil set.

In accordance with still another feature of the present invention, the contacting of the terminal of the coils of the ignition module with the connecting element is performed through plugging or cutting connection in a joint direction extending perpendicular to the connecting element.

Still another feature of the present invention is that the housing and the ignition module surrounded by it are cast from a hardenable casting resin.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
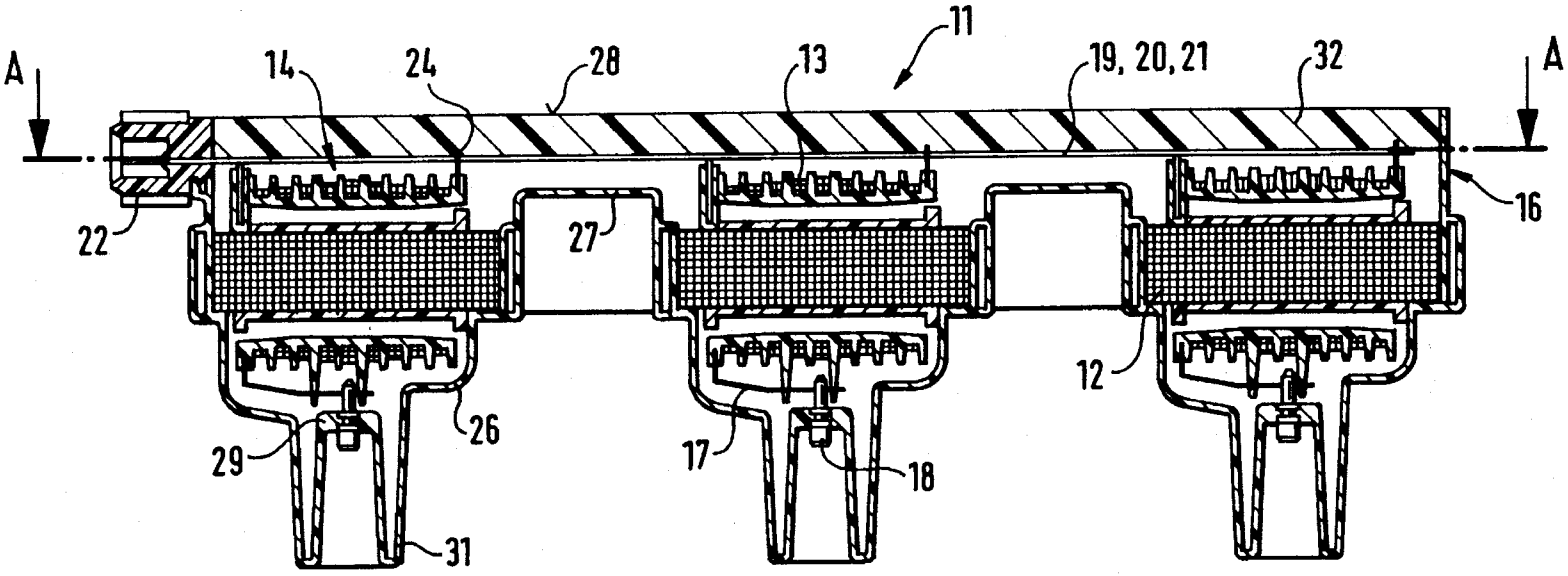
FIG. 1 is a side view of an ignition coil set in accordance with the present invention.
Figure 2:
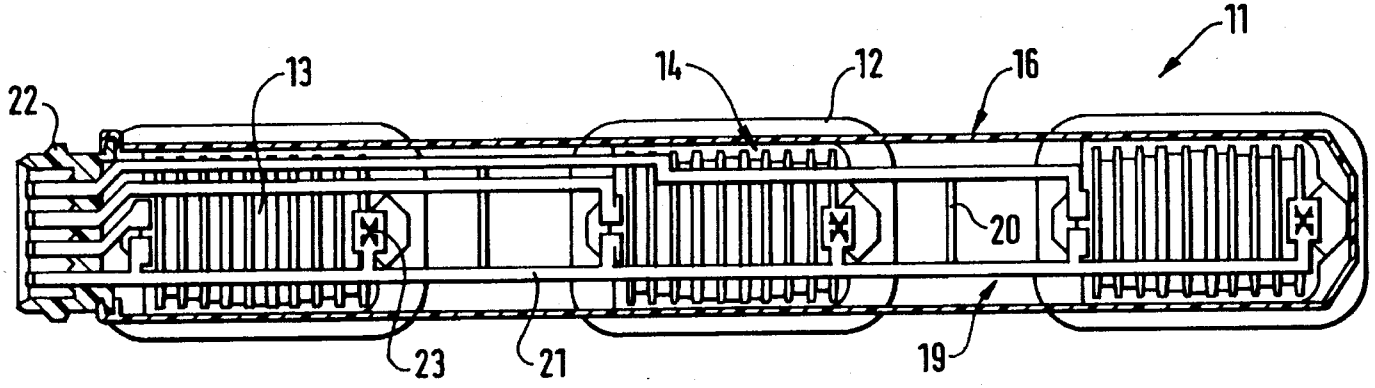
FIG. 2 is a plan view of the inventive ignition coil set in accordance with a section line A—A in FIG. 1.

An ignition coil set 11 for a multicylinder internal combustion engine in accordance with the first embodiment is shown in FIGS. 1 and 2. It has for example three identical ignition modules 14 each having a primary coil 12 and a secondary coil 13 and formed similarly to single spark coils. The ignition coil set 11 is mountable directly on the cylinder head of an internal combustion engine. It has a housing 16 in which the ignition module 14 is accommodated. Each ignition module 14 is provided with a high voltage terminal 17 which is spatially associated with each spark plug inserted in a cylinder head of the corresponding cylinder of the internal combustion engine.

The positioning of the ignition module 14 inside the ignition coil set 11 is performed through a connecting element 19. Before the beginning of mounting of the ignition coil 11, the connecting element 19 is formed as a flat punched grid which is coated with plastic up to contacting points. It has a plurality of strip-shaped busbars 21 which are mechanically stabilized by transverse webs 20 and provide power supply of terminals 24 of the primary coils 12 and the low voltage side of the secondary coils 13. The busbars 21 are accommodated at their end side as contact elements in an electrical central terminal 22 of the ignition coil set 11.

In the beginning of the mounting of the ignition coil set 11 the one-piece connecting element 19 is inserted in a not shown tool support and the transverse webs 20 are removed by punching, so that the bus bars 21 are mechanically and electrically separated from one another. Simultaneously, during this punching process circular contact openings 23 are formed in the busbars 21, and the edge regions of the contact openings are slotted radially so as to provide local springing. The contact openings 23 are used contacting with a pin and identified as speed nuts.

The terminals 24 are formed as connecting pins and constitute electrical extensions of the winding ends of the primary coils 12 and the mass or low voltage connections of the secondary coils 12. The coil sets formed as pre-mounted mounting units and each composed of one primary coil 12 and one secondary coil 13 are inserted with their terminals 24 into the contact openings 23 in a joint direction perpendicular to the connecting element 19 in form of a plug connection to provide electrical contact. Simultaneously a positioning of the coils 12, 13 on the busbars 21 is performed.

The one-piece housing 16 composed of synthetic plastic material and used for receiving the coil sets each including the primary coil 12 and the secondary coil 13 has three trough-shaped base bodies 26. The base bodies are arranged in a row in correspondence with the arrangement of the coil sets and coupled with one another by connecting walls 27. Each base body 26 is provided on its upper side with an inlet opening 28 so that the housing 16 can be fitted over the coil set. The base body 26 is closed at its lower side with a flat bottom 29. A sleeve-shaped dome 31 extends outwardly from the bottom 29 and facing away from the inlet opening 28.

A throughgoing opening is provided in the bottom 29 coaxially to the central axis of the dome 31. The high voltage contact 18 supported in the bottom 29 extends through the throughgoing opening and ends inside the dome 31.

During placement of the housing 16 on the coil set in the joint direction, the high voltage contact 18 extends into the associated contact opening 23 of the high voltage terminal 17 of the secondary coil 13 formed as a connecting plate, to establish electrical connection.

After mounting of the housing 16 the coil set is cast with a hardenable casting resin 32 and finally fixes the provisional connection of the coil sets in the housing 16 performed through the connecting element 19.

Figure 3:
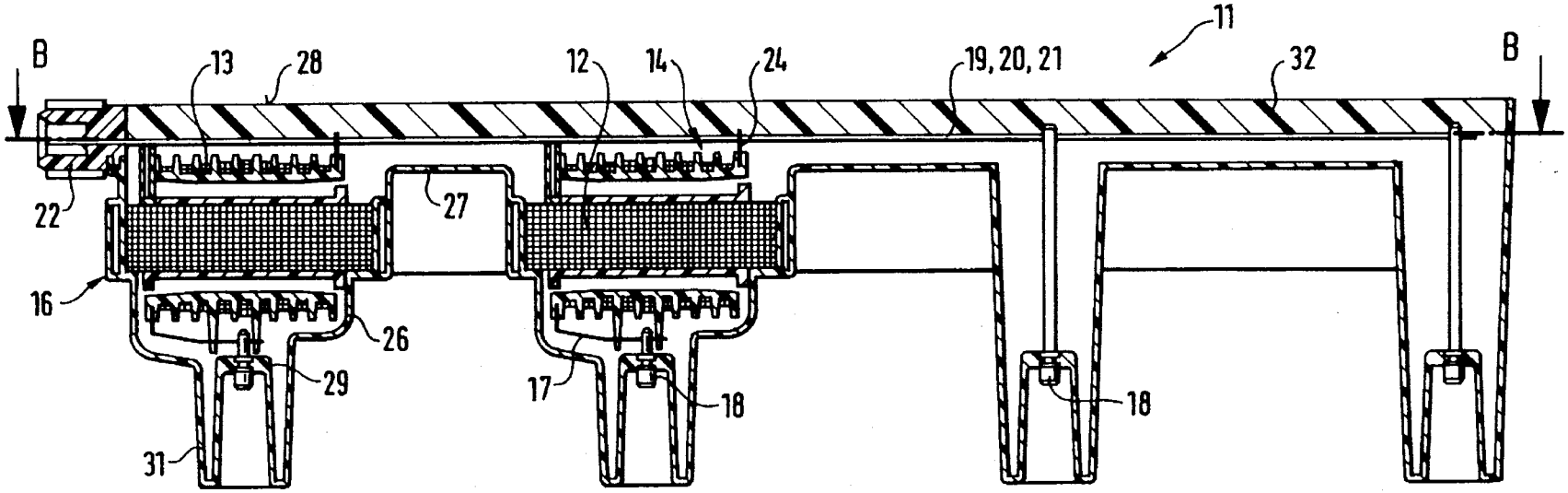
FIG. 3 is a side view of an ignition coil set in accordance with another embodiment of the present invention.
Figure 4:
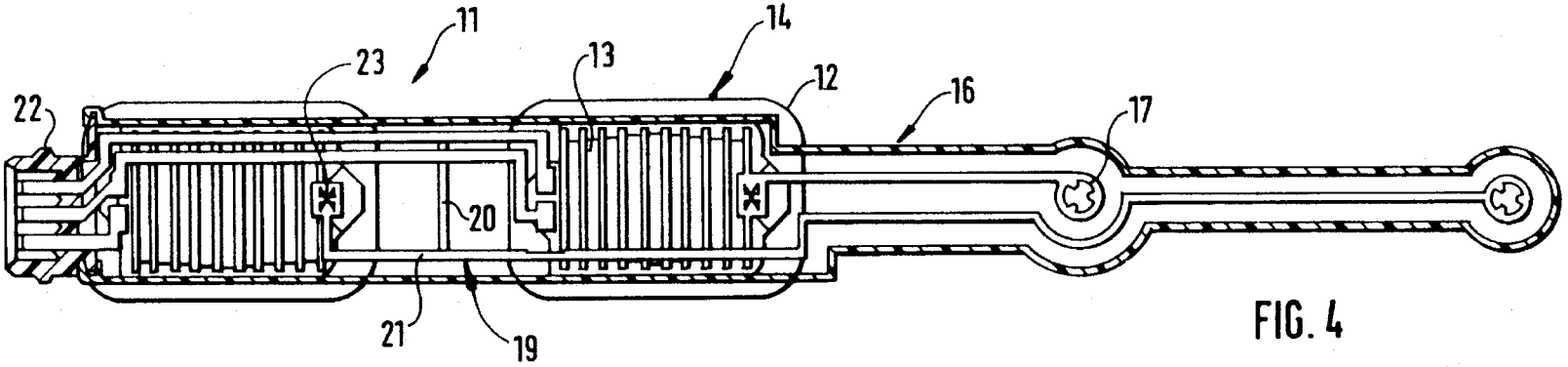
FIG. 4 is a plan view of the ignition coil set of the second embodiment in accordance with the section line B—B in FIG. 3.

The second embodiment of an ignition coil set 11 shown in FIGS. 3 and 4 has several identical ignition modules 14 formed as double spark coils having two high voltage terminals 17. The difference from the first embodiment is that the connecting element 19 is provided with a further busbar 21 for each additional high voltage terminal 17, which is formed as described hereinabove. On the one hand, it contacts with the high voltage-side winding end of the associated secondary coil 13, and on the other hand it contacts with an additional high voltage contact 18. The high voltage contact 18 is supported in simplified base body 26 provided only with the dome 31 and is form longer than the above described high voltage contact 18 for bridging the structural height of the not containing coil set here.

The common feature for both embodiments is that the ignition coil set is provided with a common connecting element 19 which mounts the ignition coil sets 11, especially in form of contacting, and the connecting element 19 is a flat connecting element subdivided into several parts by a simple punching process and requiring low manufacturing expenses.

Alternatively, the above described contacting of the connecting element 19 can be also performed as a cutting connection (sealing displacing connection).

It will be understood that each of the elements described above, or two or more together, may also find a useful application in other types of constructions differing from the types described above.

While the invention has been illustrated and described as embodied in an ignition coil set for a multicylinder internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An ignition coil set for a multicylinder internal combustion engine, comprising a housing; a plurality of substantially identical ignition modules each having a primary coil and a secondary coil and accommodated in said housing; and a common connecting element formed so as to provide positioning of said primary coils and said secondary coils and to provide electrical contacting of terminals of said primary coils and low voltage side of said secondary coils when said coils are single spark coils or distribution of high voltage when said coils are formed as double spark coils, and also to provide positioning of said housing which accommodates said ignition modules.

2. An ignition coil set as defined in claim 1, wherein said connecting element is formed as a substantially flat punched grate which is coated with synthetic plastic material and provided with contacting points.

3. An ignition coil set as defined in claim 2, wherein said connecting element is subdivided into a plurality of electrically insulated busbars which are assembled together to form a central terminal of the ignition coil set.

4. An ignition coil set as defined in claim 1, wherein said terminals of said coils of said ignition modules and said connecting element are formed so that contacting of said terminals with said connecting element is performed through connections in a joint direction perpendicular to said connecting element.

5. An ignition coil set as defined in claim 4, wherein said connections are plug connections.

6. An ignition coil set as defined in claim 4, wherein said connections are cutting connections.

7. An ignition coil set as defined in claim 1; and further comprising a body of a hardenable casting resin which is applied to said housing and said ignition modules accommodated in said housing.

* * * * *